US009909848B2

(12) United States Patent
Bootes et al.

(10) Patent No.: US 9,909,848 B2
(45) Date of Patent: Mar. 6, 2018

(54) MUNITION HAVING PENETRATOR CASING WITH FUEL-OXIDIZER MIXTURE THEREIN

(71) Applicant: Raytheon Company, Waltham, MA (US)

(72) Inventors: Thomas H. Bootes, Tucson, AZ (US); John E. Bednarz, Tucson, AZ (US); Wayne Y. Lee, Vail, AZ (US)

(73) Assignee: Raytheon Company, Waltham, MA (US)

( * ) Notice: Subject to any disclaimer, the term of this patent is extended or adjusted under 35 U.S.C. 154(b) by 8 days.

(21) Appl. No.: 14/942,236

(22) Filed: Nov. 16, 2015

(65) Prior Publication Data

US 2017/0138711 A1 May 18, 2017

(51) Int. Cl.

| | |
|---|---|
| ***F42B 12/44*** | (2006.01) |
| ***F42B 12/04*** | (2006.01) |
| ***F42B 12/46*** | (2006.01) |

(52) U.S. Cl.

CPC ..... *F42B 12/44* (2013.01); *F42B 12/04* (2013.01); *F42B 12/46* (2013.01)

(58) Field of Classification Search

CPC ..... F42B 12/20; F42B 12/201; F42B 12/202; F42B 12/204; F42B 12/205; F42B 12/207;

(Continued)

(56) References Cited

U.S. PATENT DOCUMENTS 3,981,243 A 9/1976 Doris, Jr.
4,458,597 A * 7/1984 Reynes ..... F42B 10/02 102/223

(Continued)

FOREIGN PATENT DOCUMENTS

DE 2557676 A1 6/1977
EP 1001244 A1 5/2000

(Continued)

OTHER PUBLICATIONS

International Search Report and Written Opinion for corresponding International Application No. PCT/US2016/040427 dated Apr. 3, 2017.

*Primary Examiner* — Bret Hayes
(74) *Attorney, Agent, or Firm* — Renner, Otto, Boisselle & Sklar, LLP

(57) ABSTRACT

A munition has a penetrator casing that houses a fuel-oxidizer mixture within the casing. A height of burst fuze is operatively coupled to the fuel-oxidizer mixture, to ignite the fuel-oxidizer mixture before impact with the target. By igniting the fuel-oxidizer mixture before target impact, the munition avoids the problem of the impact potentially causing damage to the fuze that would leave the fuze in operable. The fuel-oxidizer mixture may cause injury and damage into a space that has been breached by the penetrator casing, for example by expelling lethal combustion products (hot gases) into a hard target, such as a building or bunker, that has been breached by the penetrator casing. The hot gasses may also have the advantage of maintaining an opening that the penetrator passes through, with for example the hot gases glassifying the edges of a hole formed by the penetrator, such as through soil.

12 Claims, 6 Drawing Sheets

(58) Field of Classification Search
CPC ..... F42B 12/04; F42B 12/06; F42B 12/44; F42B 12/46; F42B 12/52
USPC .... 102/364, 365, 396, 397, 477, 499, 275.9, 102/275.11
See application file for complete search history.

(56) References Cited

U.S. PATENT DOCUMENTS

| | | | | |
|---|---|---|---|---|
| 4,592,283 | A | 6/1986 | Hellner et al. | |
| 4,648,323 | A | 3/1987 | Lawther | |
| 5,117,759 | A | 6/1992 | Henderson et al. | |
| 5,131,329 | A | 7/1992 | Lips et al. | |
| 5,305,505 | A | 4/1994 | Ruhlman | |
| 5,535,679 | A | 7/1996 | Craddock | |
| 5,939,662 | A | 8/1999 | Bootes et al. | |
| 6,105,505 | A | 8/2000 | Jones | |
| 6,186,072 | B1 | 2/2001 | Hickerson, Jr. et al. | |
| 6,374,744 | B1 | 4/2002 | Schmaker et al. | |
| 6,382,105 | B1 | 5/2002 | Jones | |
| 6,484,642 | B1 | 11/2002 | Kuhns et al. | |
| 6,601,517 | B1 | 8/2003 | Guirguis | |
| 6,619,210 | B1 | 9/2003 | Spivak et al. | |
| 6,659,013 | B1 | 12/2003 | Kellner | |
| 7,098,841 | B2 * | 8/2006 | Hager | F42C 13/04 102/206 |
| 7,533,612 | B1 * | 5/2009 | Papayianis | F42C 11/001 102/211 |
| 7,614,348 | B2 | 11/2009 | Truitt et al. | |
| 8,061,275 | B1 | 11/2011 | Gold | |
| 8,191,479 | B2 | 6/2012 | Ruhlman et al. | |
| 8,234,979 | B1 | 8/2012 | Falabella et al. | |
| 8,671,840 | B2 | 3/2014 | Scheid et al. | |
| 8,701,557 | B2 | 4/2014 | Biggs et al. | |
| 2005/0115450 | A1 | 6/2005 | Lloyd | |
| 2006/0162941 | A1 * | 7/2006 | Sridharan | A62C 3/025 169/53 |
| 2010/0107915 | A1 * | 5/2010 | Geswender | F42B 12/365 102/211 |
| 2011/0011295 | A1 * | 1/2011 | Geisler | F42B 12/44 102/364 |
| 2012/0186479 | A1 | 7/2012 | Skidmore et al. | |
| 2012/0291651 | A1 | 11/2012 | Haumann et al. | |

FOREIGN PATENT DOCUMENTS

| | | | |
|---|---|---|---|
| EP | 1367358 | A2 | 12/2003 |
| EP | 1864960 | A2 | 12/2007 |
| FR | 2910612 | A1 | 6/2008 |
| GB | 2384291 | A | 7/2003 |
| WO | 9830863 | A1 | 7/1998 |
| WO | 2000/005545 | A2 | 2/2000 |
| WO | 2008089078 | A2 | 7/2008 |
| WO | 2009102254 | A1 | 8/2009 |
| WO | 2011054361 | A1 | 5/2011 |
| WO | 2015175036 | A2 | 11/2015 |
| WO | 2015175037 | A2 | 11/2015 |
| WO | 2015175038 | A2 | 11/2015 |
| WO | 2015175039 | A2 | 11/2015 |
| WO | 2015175040 | A2 | 11/2015 |
| WO | 2016022181 | A1 | 2/2016 |
| WO | 2016022199 | A1 | 2/2016 |

* cited by examiner

MUNITION HAVING PENETRATOR CASING WITH FUEL-OXIDIZER MIXTURE THEREIN

FIELD OF THE INVENTION

The invention relates to munitions, for example munitions configured for use against hard targets or other enclosures.

DESCRIPTION OF THE RELATED ART

Conventional hard target penetrator warheads utilize various types of conventional explosives to generate short duration blast and fragmentation effects that create catastrophic damage of target contents and/or target structure, such as a hard building or a bunker. Difficulties arise with delivery of such blast and/or fragmentation warheads for missions that require limited, controlled or special damage effects against certain hard targets.

SUMMARY OF THE INVENTION

A warhead (of a munition) has a penetrator casing that encloses a fuel-oxidizer mixture, which is activated by a height-of-burst fuze before initial impact with a target.

A warhead (of a munition) has a penetrator casing that encloses a fuel-oxidizer mixture that is ignited before initial impact, and continues combustion after impact, for example into an interior space of a target.

According to an aspect of the invention, a munition includes: a penetrator casing; a fuel-oxidizer mixture within the penetrator casing; and a height-of-burst fuze operatively coupled to the fuel-oxidizer mixture. The fuze is configured to ignite the fuel-oxidizer mixture before initial impact of the penetrator casing with a target, with the fuel-oxidizer mixture continuing combustion within the casing after the initial impact.

According to an embodiment of the device of any paragraph(s) of this summary, the penetrator casing has a nose, and a cylindrical aft section extending back from the nose.

According to an embodiment of the device of any paragraph(s) of this summary, the nose has a thickest portion that is at least twice the thickness of a thickest portion of the aft section.

According to an embodiment of the device of any paragraph(s) of this summary, the fuel-oxidizer mixture has a burn time of at least 10 seconds.

According to an embodiment of the device of any paragraph(s) of this summary, the fuel-oxidizer mixture has a burn time of at least one hour.

According to an embodiment of the device of any paragraph(s) of this summary, the fuze contains an explosive or other special device that is used to initiate combustion of the fuel-oxidizer mixture.

According to an embodiment of the device of any paragraph(s) of this summary, the device includes a shock damper between the fuze and the fuel-oxidizer mixture.

According to an embodiment of the device of any paragraph(s) of this summary, the device includes a sensor that is operatively coupled to the fuze, wherein the sensor sends a triggering signal to the fuze at a predetermined height.

According to an embodiment of the device of any paragraph(s) of this summary, the fuze is in a fuzewell.

According to an embodiment of the device of any paragraph(s) of this summary, the fuzewell has vent spaces for allowing combustion gases from combustion of the fuel-oxidizer mixture to pass therethrough.

According to another aspect of the invention, a munition includes: a penetrator casing; a fuel-oxidizer mixture within the penetrator casing; and a height-of-burst fuze operatively coupled to ignite the fuel-oxidizer mixture. The fuel-oxidizer mixture has a burn time of at least 10 seconds.

According to yet another aspect of the invention, a method of attacking a target with a munition includes the steps of: prior to initial impact of the munition with the target, igniting a fuel-oxidizer mixture of the munition that is inside a penetrator casing of the munition; and subsequent to the igniting, penetrating the target with the penetrator casing. Combustion of the fuel-oxidizer mixture continues during and after the target has been penetrated by the penetrator casing.

According to an embodiment of the method of any paragraph(s) of this summary, the method includes, after the penetrating, expelling combustion gases produced by combustion of the fuel-oxidizer mixture, into an interior space of the target.

According to an embodiment of the method of any paragraph(s) of this summary, the expelling occurs directly into the interior space, with the penetrator casing and the fuel-oxidizer mixture in the interior space.

According to an embodiment of the method of any paragraph(s) of this summary, the expelling occurs indirectly into the interior space, with the penetrator casing and the fuel-oxidizer mixture in a hole made by the penetrator casing, with the combustion gases reaching the interior space by traveling back through the hole.

According to an embodiment of the method of any paragraph(s) of this summary, the hole is made in soil; and According to an embodiment of the method of any paragraph(s) of this summary, the method includes, as the hole is made, maintaining the hole open by glassifying the soil that defines the whole, using the hot combustion gases.

According to an embodiment of the method of any paragraph(s) of this summary, the igniting includes igniting the fuel-oxidizer mixture using a height-of-burst fuze of the munition that is configured to trigger at a predetermined height and/or at a predetermined time prior to the initial impact.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A munition has a penetrator casing that houses a fuel-oxidizer mixture within the casing. A height of burst fuze is operatively coupled to ignite the fuel-oxidizer mixture before impact with the target. By igniting the fuel-oxidizer mixture before target impact, the munition avoids the problem of the impact potentially causing damage to the fuze that would leave the fuze unable to ignite the fuel-oxidizer mixture. The fuze may be in a fuzewell that has vents in it that allow combustion gases to be vented from the munition during flight and after initial impact. The fuel-oxidizer mixture may cause injury and damage into a space that has been breached by the penetrator casing, for example by expelling lethal combustion products (hot gases) into a hard target, such as a building or a bunker, that has been breached by the penetrator casing. The hot gasses may also have the advantage of maintaining an opening that the penetrator passes through, with for example the hot gases glassifying the edges of a hole formed by the penetrator, such as through soil. This may allow the hot combustion gases to reach a desired target, for example the space inside a hard target such as a building or bunker, even when the munition "overshoots" the target, for example plowing into soil beneath the hard target. The hot combustion gases maintain the penetration hole open to act as a portal, for the hot combustion gases to propagate back through the flight path of the penetrator. In addition to increasing the lethality of the munition (and/or the damage it inflicts), the fuel-oxidizer mixture may also be utilized to generate thrust to the munition for increased penetration depth.

Figure 1:
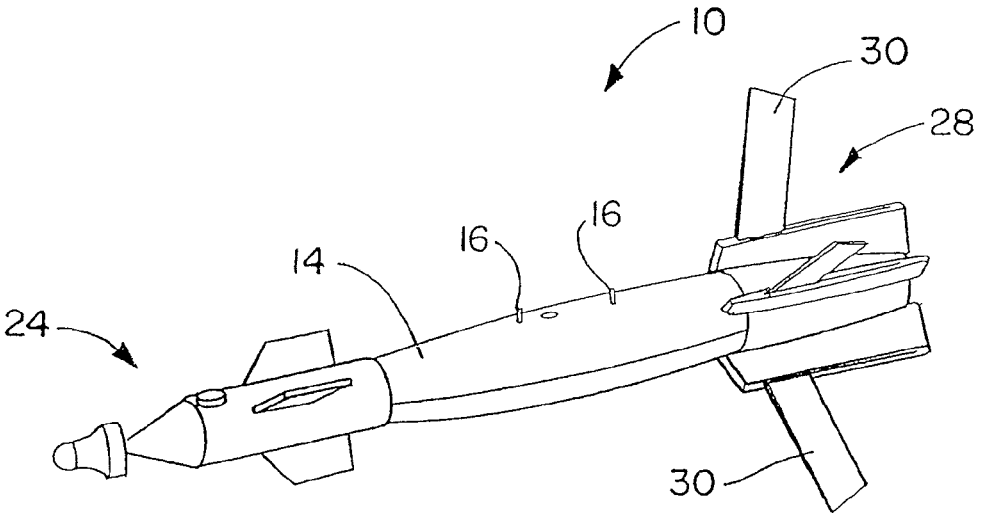
FIG. 1 is an oblique view of a munition in accordance with the present invention.
Figure 2:
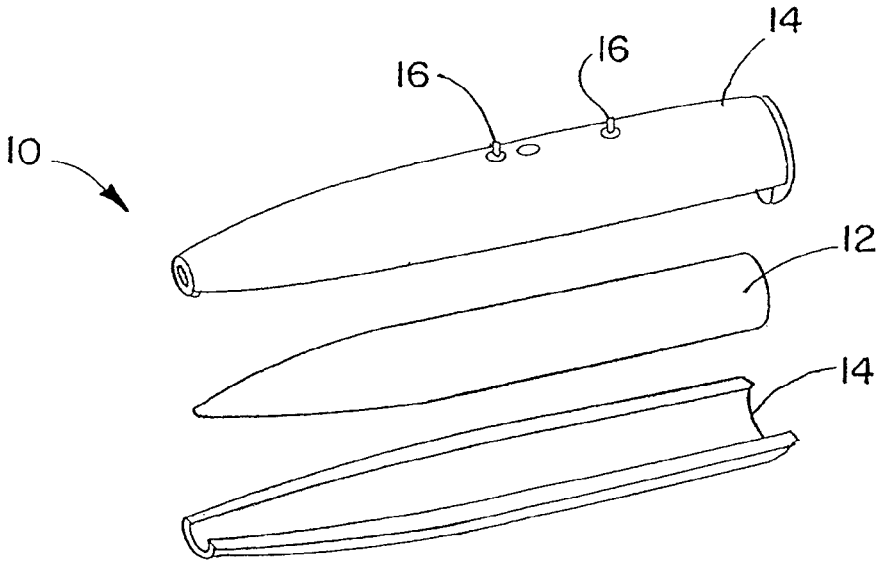
FIG. 2 is an exploded view showing parts of the munition of FIG. 1.

Referring initially to FIGS. 1 and 2, a munition 10, such as a missile or guided bomb, has a warhead 12 that is contained within an airframe 14 that has connection lugs 16 for connection to an aircraft or other platform for launching the munition 10. The airframe 14 has a forward connection for receiving a guidance nose kit 24 (for example), and an aft connection for receiving (for example) a tail kit 28 with deployable fins 30. The airframe 14 may be configured for using a standard weapons mount on a launch platform that is also able to receive other types of weapons. The forward and aft connections may be standard connections that are similar to those used for other munitions, thus enabling use of standard nose and tail kits that may be used with other sorts of munitions. The airframe 14 may be in the form of a pair of clamshell halves that fit around the warhead 12, and may be made of a relatively lightweight material, such as aluminum.

Figure 3:
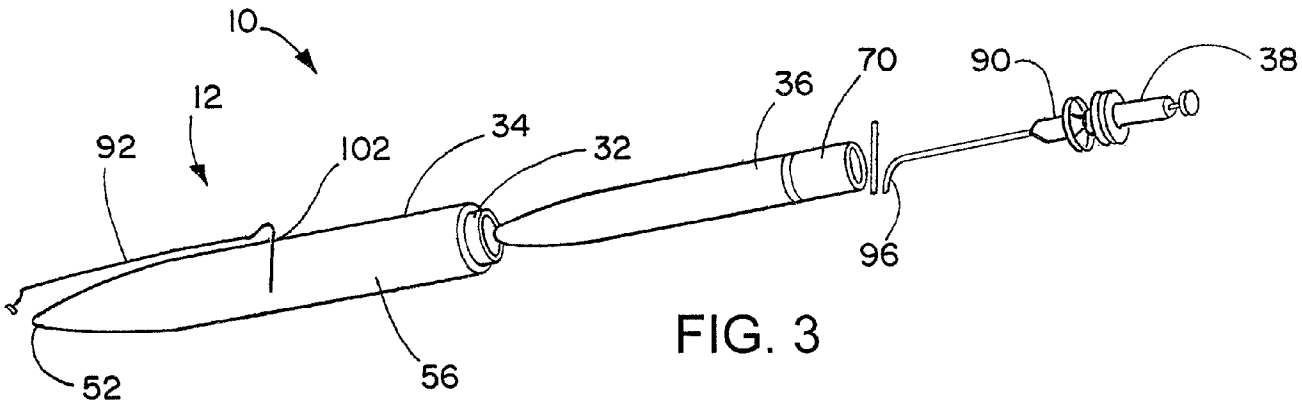
FIG. 3 is an exploded view of some components of the munition of FIG. 1.
Figure 4:
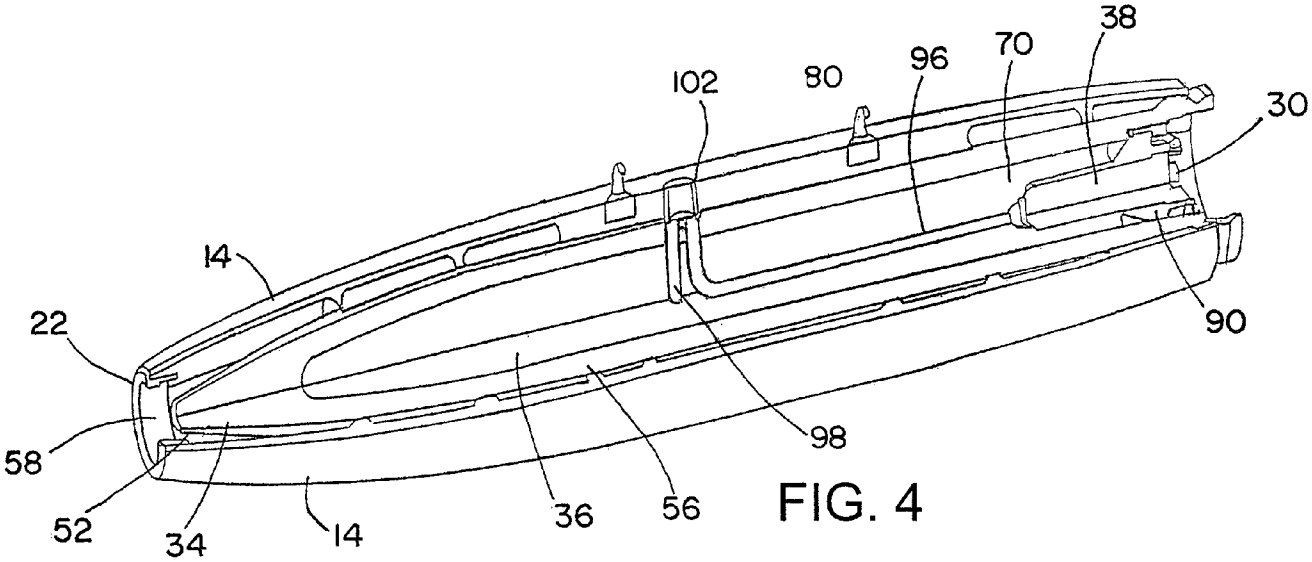
FIG. 4 is a partial sectional view of the warhead of the munition of FIG. 1.

With reference now in addition to FIGS. 3 and 4, the warhead 12 has a penetrator casing 34 that encloses a fuel-oxidizer mixture 36. The fuel-oxidizer mixture 36 is initiated by a fuze 38 that is at an aft end of the fuel-oxidizer mixture 36. The fuze 38 may contain an explosive which is detonated to provide heat and pressure that directly ignites the fuel-oxidizer mixture 36. Alternatively the fuze 38 may not contain explosives, but which utilizes other mechanisms to initiate the fuel-oxidizer mixture 36.

The fuel-oxidizer mixture or 36 may be a material that burns as low as 260 degrees C. (500 degrees F.) as a gas generator for low temperature specialized gas effects. Alternatively, the fuel-oxidizer mixture 36 may be a material that burns at a minimum of 1650 degrees C. (3000 degrees F.) to generate thermal damage effects. The fuel-oxidizer mixture 36 actually burns at a higher temperature, such as at 2760 degrees C. (5000 degrees F.) or greater temperatures. This high-temperature combustion of the fuel-oxidizer mixture 36 produces very hot combustion gas products, that can cause damage to the target (personnel and equipment).

The fuel-oxidizer mixture 36 is used primarily to neutralize the target of the munition 10. The mixture 36 does this by producing hot combustion gases or other special effects when it burns.

In an example embodiment the munition may have a total mass of about 360 kg (800 lbs), with the fuel-oxidizer mixture 36 having a mass of about 60 kg (135 lbs). Many other relative weights are possible. In some embodiments the fuel-oxidizer mixture 36, the combined mass of the oxidizer and the fuel, may be from 5% to 50% of the mass of the warhead 12. In other embodiments the mass of the fuel-oxidizer mixture 36 may be 10% to 30% of the mass of the warhead 12. It will be appreciated that these ranges are only examples, and that other ranges may be used within any subset of these ranges, with one or more different end points.

The casing 34 has a forward nose 52, and an aft section 56 extending back from the nose 52. In the illustrated embodiment, the forward nose 52 of the penetrator casing 34 is solid in nature, a monolithic structure with no cutout or through holes to accommodate forward mounted fuzing such as that used in general purpose bomb cases. The forward nose 52 is thickest at an apex 58 of the nose 52, and has a thickness that reduces the farther back you go along the casing 34, tapering gradually to the thickness of the substantially cylindrical aft section 56. The nose 52 may have a maximum thickness that is at least twice the thickness of the thickest part of the casing 34 in the cylindrical aft section 56.

Portions of the penetrator casing aft section 56 may be thinner than other portions of the aft section 56, for example to achieve a desired weight distribution within the warhead 12, or more generally within the munition 10. For example, parts of the aft section 56 may have holes or grooves in them.

The penetrator casing 34 may be made out of a suitable metal, such as a suitable steel (for example 4340 steel) or another hard or high strength penetrating material, such as titanium. Aluminum and composite materials are other possible alternatives. The fuel-oxidizer mixture 36 is a solid material containing both fuel and oxidizer. Examples of a fuel-oxidizer mixture suitable for use in the munition 10 include, but are not limited to, combustible fuel materials (such as aluminum or magnesium powder), solid constituents/oxidizers (such as ammonium perchlorate (AP) or ammonium nitrate (AN)) and binder materials (such as hydroxyl-terminated polybutadiene (HTPB), cross-linked double-base (XLDB) or composite modified double base (CMDB)). Other suitable materials may be used instead, or in addition to, the materials listed above.

A shock damper or attenuation device 70 is located between the fuel-oxidizer mixture 36 and a fuzewell 90 that houses the fuze 38. The shock damper 70 is used to protect the fuel-oxidizer mixture 36 from damage induced by fuzes with explosive boosters that create detonation blast and other mechanical shock. The shock damper allows thermal and non-damaging lower pressure effects to pass on to and ignite the fuel-oxidizer mixture 36. The shock damper 70 may include a single material or multiple layers of different materials, to spread out, divert, reflect, and/or otherwise reduce the effect of mechanical shock. The materials of the shock damper 70 may be combustible, such that triggering of the fuze 38 commences combustion in the shock damper 70 which in turn initiates combustion of the fuel-oxidizer mixture 36. The shock damper functions as a filter that allow the transfer of thermal energy while reducing, but not total eliminating, pressure induced by blast and other mechanical shock to an acceptable level (i.e. upward of tens of thousands of psi down to a few thousands or less psi pressure) in order to properly initiate the fuel-oxidizer mixture.

The fuze 38 is located at an aft end of the munition 12. The fuze 38 is operably coupled to the nose kit 24, for example to receive from the nose kit 24 a signal to detonate the fuze 38. The nose kit 24 may include a sensor or detector 40 (FIG. 1) that it is used to provide a signal to trigger the firing of the fuze 38. The triggering event may be the munition 10 reaching a desired height for detonation (height of burst), for example.

The connection between the nose kit 24 and the fuze 38 includes an external electrical harness 92 that connects to and runs through a conduit 98 that is inside the fuel-oxidizer mixture 36. The harness 92 runs outside of the casing 34, between the casing 34 and the airframe 14. A forward end of the harness 92 is coupled to the nose kit 24 at the forward connection 22 near the nose 52 of the casing 34. An aft end of the harness 92 is connected to a coupling 102 in the middle of the casing 34. From the coupling 102 the signal travels back to the fuze 38 through the electrical line or cable that runs within the conduit 96. An umbilical cable (not shown) may also be connected to the fuze 38, to provide data, instructions, or other information to the munition 10 prior to launch.

Figure 5:
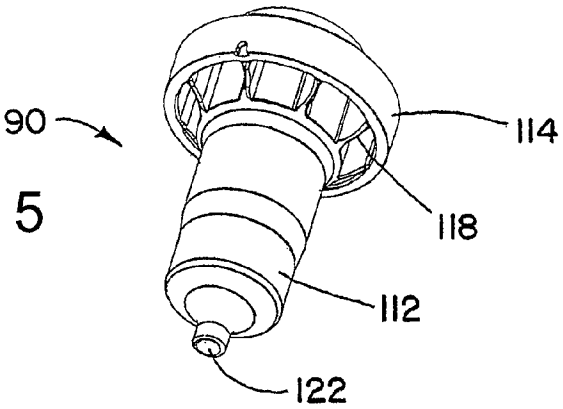
FIG. 5 is an oblique view of a fuzewell of the munition of FIG. 1.
Figure 6:
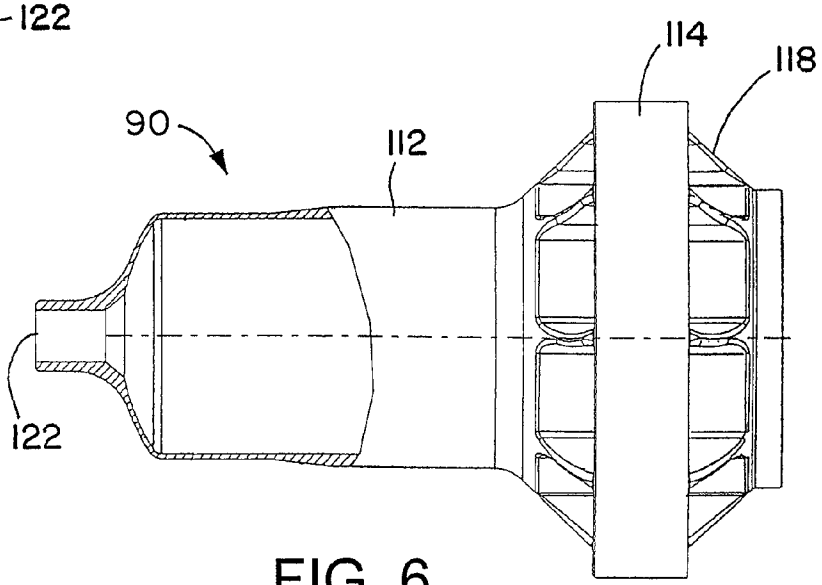
FIG. 6 is a side partial sectional view of the fuzewell of FIG. 5.
Figure 7:
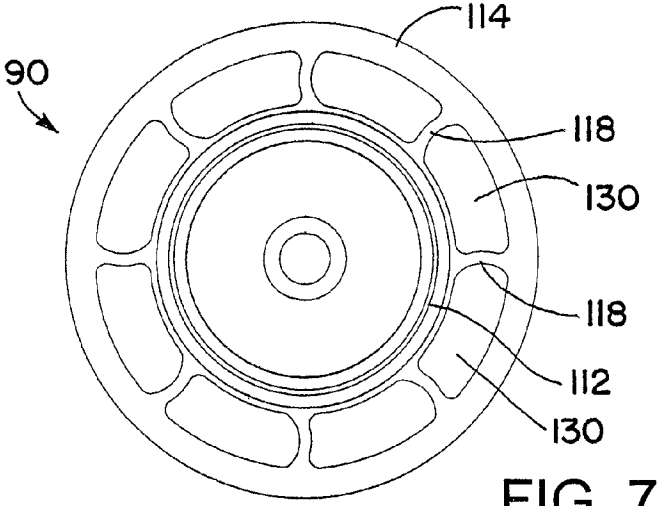
FIG. 7 is an end view of the fuzewell of FIG. 5.

With reference now in addition to FIGS. 5-7, the fuzewell 90 houses and provides some protection for the fuze 38 (FIG. 4). The fuzewell 90 has a central housing 112 that contains the fuze 38, and a ring 114 around the central housing 112 that is connected to the housing 112 by a series of spokes 118. An opening 122 in the housing 112 enables connection to the fuse 38 of the electrical line that runs within the conduit 96.

The fuzewell 90 defines spaces 130 between the spokes 118. The spaces 130 allow for venting of gases from the fuel-oxidizer mixture 36 (FIG. 3). The spaces 130 allow egress of combustion gases produced by burning of the fuel-oxidizer mixture 36. The combustion gases may also pass through a suitable passage in the tail kit 28 (FIG. 1), which is not shown. In addition the spaces 130 may be used in manufacturing of the munition 10, for example by allowing pouring of the fuel-oxidizer mixture 36 into the casing 34, through the spaces 130, after the fuzewell 90 has been put into place. In addition the material for the shock damper 70 may be poured into the casing 34 through the spaces 130, after the fuel-oxidizer mixture 36 has been put in place.

The fuzewell 90 may be made of steel, another suitable material, or a combination of high strength materials (i.e. bi-metallic case/shock dampening flange). The fuzewell 90 may be made as a single piece of material.

The fuze 38 may be configured to ignite the fuel-oxidizer mixture 36 before impact of the target. The ignition of the fuel-oxidizer mixture 36 may come at a desired height above the target. Alternatively the ignition of the fuel-oxidizer mixture 36 may occur at a predetermined time before impact with the target. Both of these triggering events may be considered characteristic of a height-of-burst fuze. The conditions under with the fuze 38 is triggered may be alterable to meet desired operational characteristics.

The fuel-oxidizer mixture 36 may be configured to have a burn time well in excess of the time in flight after the fuze 38 is activated to initiate combustion in the fuel-oxidizer mixture 36. The fuel-oxidizer mixture 36 may be configured, for example, to burn from 10 seconds to over an hour after initiation of the combustion. However it will be appreciated that a wide variety of burn times may be selected to achieve desired performance. Burn time may be controlled, for instance, by selection of the amount of the fuel-oxidizer mixture 36, the type of incendiary material (the fuel and/or oxidizer) used for the fuel-oxidizer mixture 36, and/or the geometry or internal ballistics characteristics of the fuel-oxidizer mixture 36 (the size and/or shape of the fuel-oxidizer mixture, as well as characteristics, such as grooves, that may affect the shape of the burn front).

Figure 8:
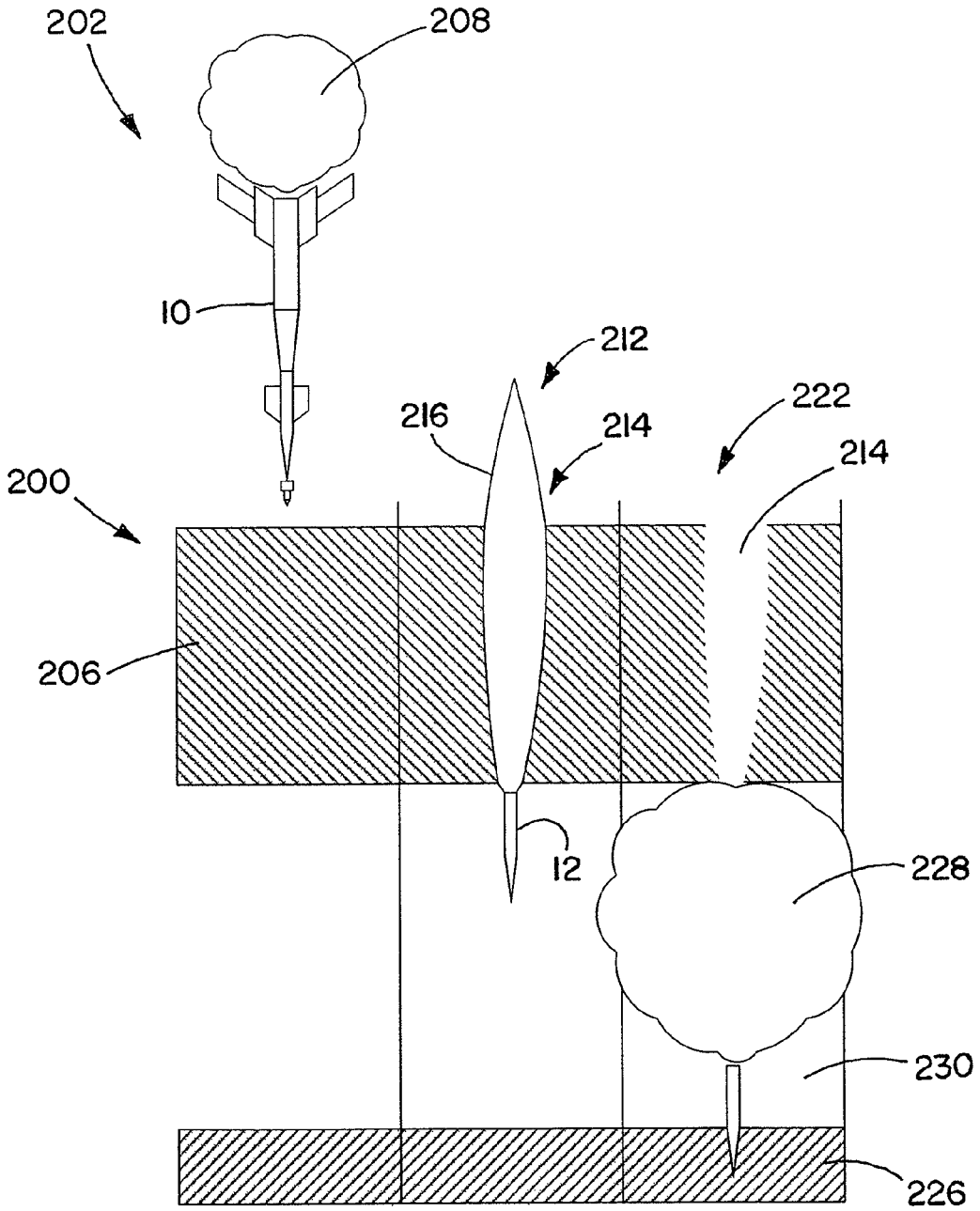
FIG. 8 schematically shows a first use of the munition of FIG. 1, in attacking a hard target structure.

FIG. 8 illustrates one use of the munition 10, in attacking a hard concrete target 200. In a first step of the process, shown at 202, the fuel-oxidizer mixture 36 (FIG. 3) of the munition 10 is ignited before impact of the munition against the concrete outer wall 206. The ignition of the fuel-oxidizer mixture 36 produces some expelled hot combustion gases 208. This may produce additional thrust which may provide increased velocity to the munition 10 prior to its impact with the outer wall 206.

When the munition 10 impacts the concrete wall 206, many of the parts of the munition break apart. Only the warhead 12 passes into the wall 206 intact, as shown at 212 in FIG. 8. As the warhead 12 makes an entry hole 214 through the outer wall 206, a plume of hot exhaust gases 216, a product of the combustion of the fuel-oxidizer mixture 36 (FIG. 3), may fill the hole 214.

As shown at 222, the warhead 12 ends up making an impact in a floor 226 of the target 200. Hot combustion gases 228 fill the interior space 230 of the target 200. The hot combustion gases 228 may be toxic to breathe (without long term toxicity to the surround environment), and the heat of the gases 228 may be damaging to equipment and personnel, thus neutralizing the target 200.

Figure 9:
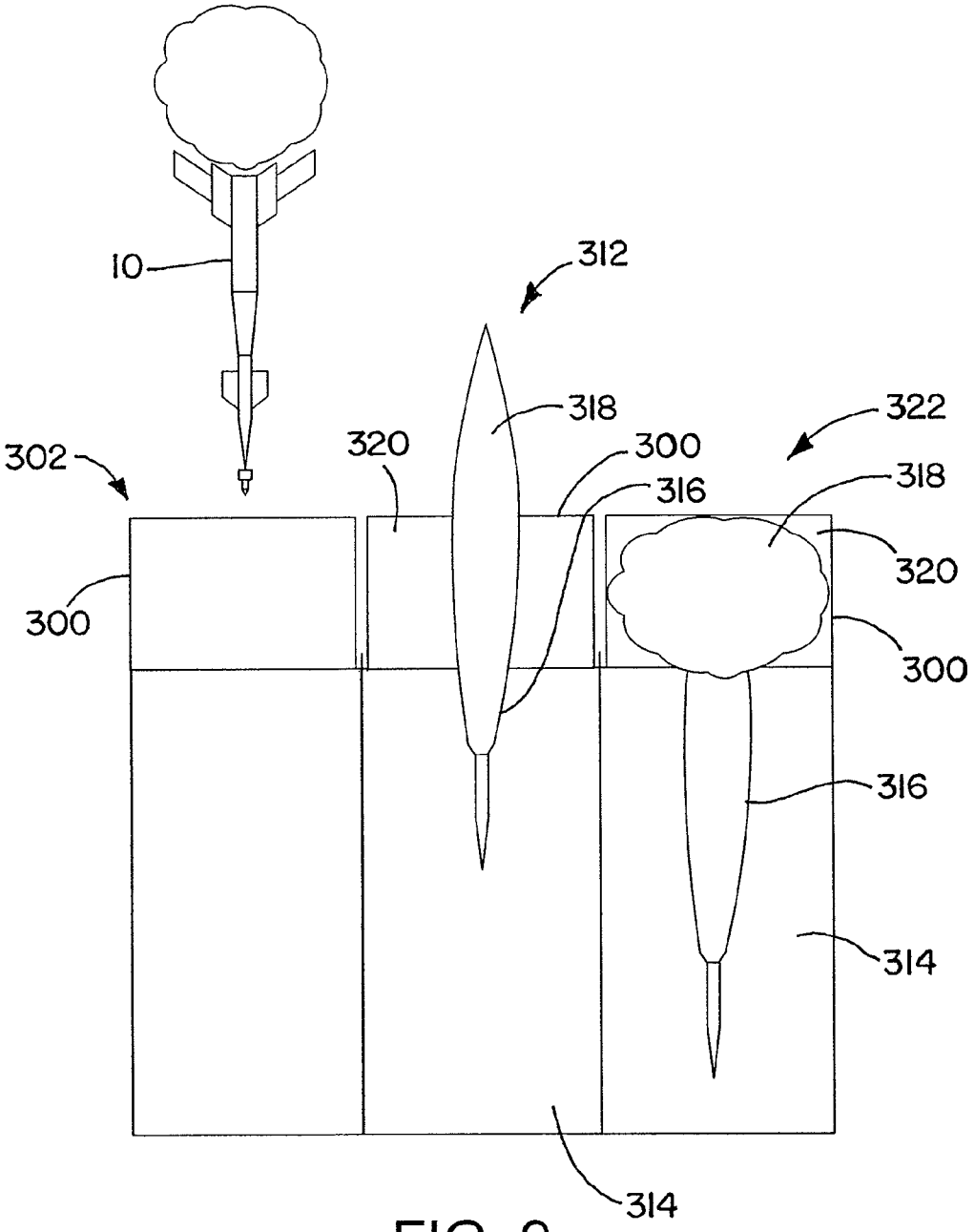
FIG. 9 schematically shows a second use of the munition of FIG. 1, in attacking a soft building target.

FIG. 9 illustrates another use of the munition 10, in attacking a soft building target 300. In a first step, shown at 302, the munition 10 approaches the building target 300, with the fuel-oxidizer mixture firing when the munition 10 is above the building target 300.

In a subsequent step, shown at 312, the munition 10 makes impact with the building 300. The warhead 12 passes completely through the building 300 and burrows into the soil 314 below the building 300, making a hole 316 in the soil 314. However hot combustion gases 318 from the warhead 12 migrate upward from the hole 314 into an interior space 320 of the building 300, filling the interior space 320, as shown at 322. As discussed above, the heating from the hot combustion gases may aid in keeping the hole 316 open to allow venting of combustion gases into the building interior 320. Glassification of the soil 314 around the hole 316 may help keep the hole 316 from collapsing.

Figure 10:
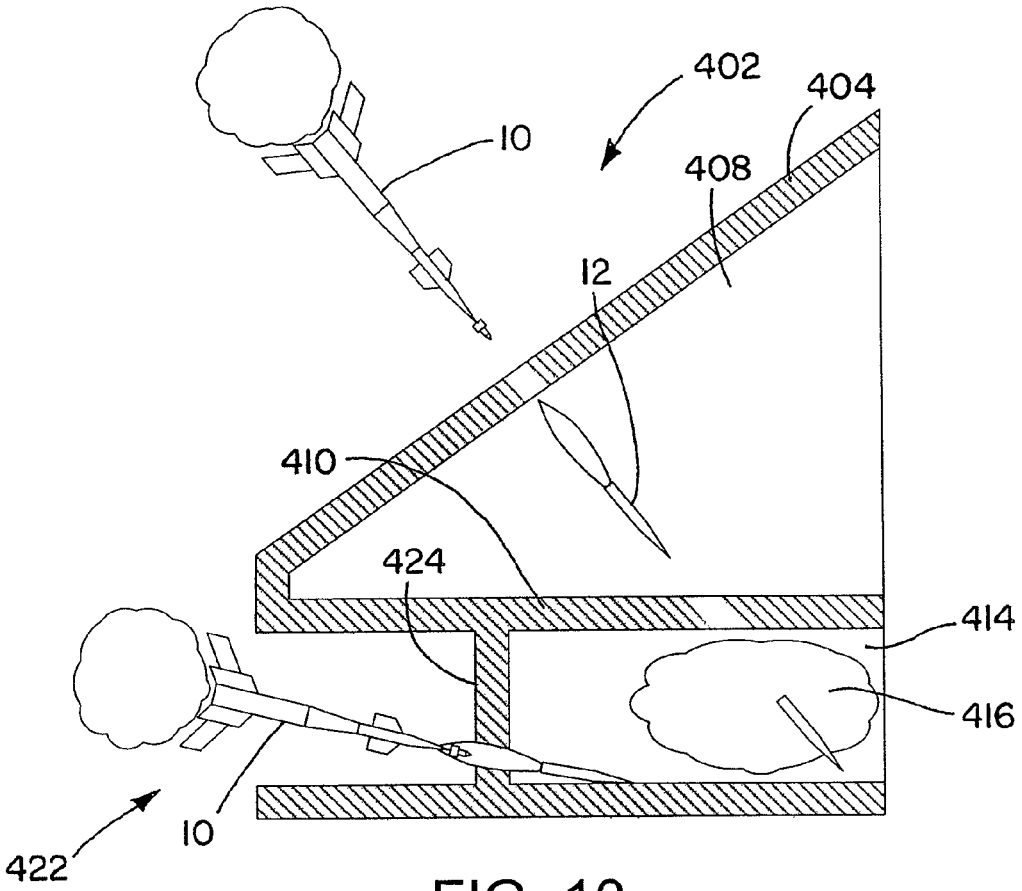
FIG. 10 schematically shows a third use of the munition of FIG. 1, in attacking a cave/tunnel target.

FIG. 10 illustrates the munition 10 being used at two different angles against a cave/tunnel target 400 (400 is missing from FIG. 10). In a high-angle use, shown at 402, fuel-oxidizer mixture of the munition 10 ignites before the munition 10 makes impact with a soil layer 404 covering a granite or rock underlayer 408. The warhead 12 proceeds through the soil layer 404, the granite underlayer 408, and a tunnel roof 410, into an interior space 414. There hot exhaust gases 416 from the warhead 12 are expelled, filling the interior space 414, neutralizing the target.

In a low-angle alternative use, shown at 422, again the fuel-oxidizer mixture of the munition 10 is ignited during flight of the munition, before impact. After impact of the munition 10 with a barrier 424 at the front of the tunnel/cave, the warhead 12 continues on into the interior space 414. There the warhead 12 again fills the interior space with hot exhaust gases.

Figure 11:
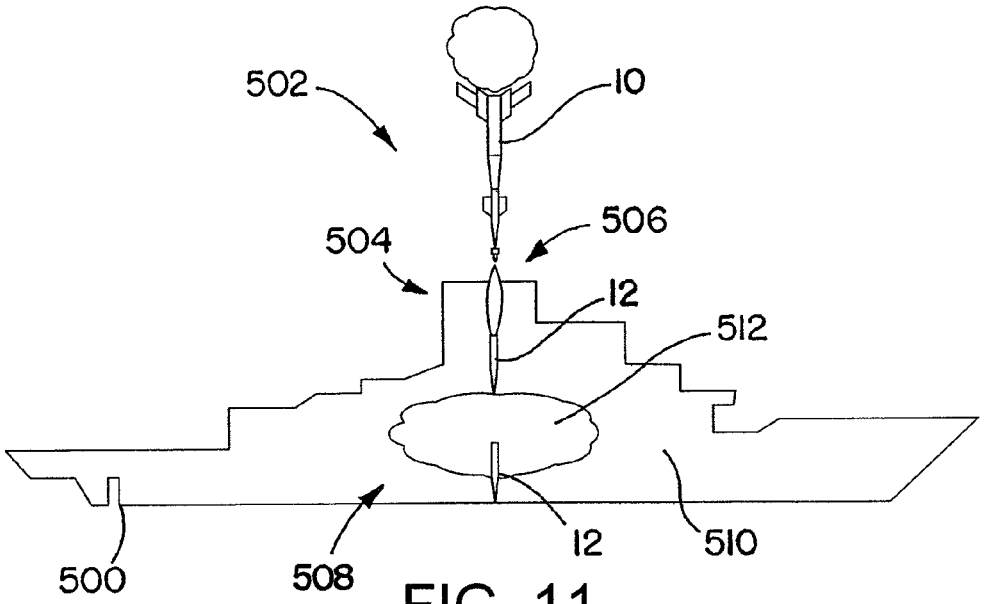
FIG. 11 schematically shows a fourth use of the munition of FIG. 1, in attacking a ship.

FIG. 11 shows another potential use for the munition 10, in attacking a ship 500. As shown at 502, the fuel-oxidizer mixture is ignited before collision with the ship 500. As shown at 504, the impact of the munition 10 with the ship 500 produces a hole 506 in the ship 500, through which the penetrator 12 of the munition 10 continues. Finally, as shown at 508, the penetrator 12 reaches an interior space 510 of the ship 500. The penetrator 12 fills the interior space with hot exhaust gases 512. The hot exhaust gases may be produced for long after entry of the penetrator 12 into the interior space 510, for example for as long as an hour, doing considerable damage to the interior of the ship 500.

As discussed about, all or part of the fuel-oxidizer mixture 36 (FIG. 3) may be used in various embodiments in order to provide thrust for increased velocity to the munition 10. In some embodiments the fuel-oxidizer mixture 36 may be split into multiple segments that can be ignited separately, for example with one segment actuated mid-flight to provide additional thrust, for example to increase range, and the other segment ignited just before impact, to provide combustion gases for target neutralization. Alternatively all or part of the fuel-oxidizer mixture 36 may be used in various embodiments in order to provide thermal or other special effects to the munition 10.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A munition comprising:

a single-piece, monolithic penetrator casing;

a fuel-oxidizer mixture within the penetrator casing; and a height-of-burst fuze operatively coupled to the fuel-oxidizer mixture;

wherein the fuze is configured to ignite the fuel-oxidizer mixture before initial impact of the penetrator casing with a target, with the fuel-oxidizer mixture continuing combustion within the casing during and after the initial impact;

wherein the penetrator casing has a nose with a pointed end, and a cylindrical aft section extending back from the nose; and wherein the nose has a thickest portion that is at least twice the thickness of a thickest portion of the aft section, with thickness of the penetrator casing tapering from the nose to the aft section.

2. The munition of claim 1, wherein the fuel-oxidizer mixture has a burn time of at least 10 seconds.

3. The munition of claim 1, wherein the fuel-oxidizer mixture has a burn time of at least one hour.

4. The munition of claim 1, wherein the fuze contains an explosive that is used to initiate combustion of the fuel-oxidizer mixture.

5. The munition of claim 1, further comprising a shock damper between the fuze and the fuel-oxidizer mixture.

6. The munition of claim 1, further comprising a sensor that is operatively coupled to the fuze, wherein the sensor sends a triggering signal to the fuze at a predetermined height.

7. The munition of claim 1, wherein the fuze is in a fuzewell; and wherein the fuzewell has vent spaces for allowing combustion gases from combustion of the fuel-oxidizer mixture to pass therethrough.

8. The munition of claim 1, wherein the casing, the fuel-oxidizer mixture, and the fuze are parts of a warhead.

9. The munition of claim 8, wherein the mass of the fuel-oxidizer mixture is 10% to 30% the mass of the warhead.

10. The munition of claim 8, further comprising an airframe, and wherein the warhead is contained within the airframe.

11. The munition of claim 10, wherein the airframe includes connection lugs.

12. The munition of claim 8, wherein the fuel-oxidizer mixture has a mass of 5% to 50% of the mass of the warhead.

* * * * *